United States Patent [19]

Phelps et al.

[11] 4,420,174

[45] Dec. 13, 1983

[54] IDENTIFICATION CARD BEARING LATENT IMAGE PERCEPTIBLE IN THE PRESENCE OF BACKGROUND LIGHT

[75] Inventors: Barry C. Phelps; John S. Hall, both of Sacramento, Calif.

[73] Assignee: California Interface and Software Limited Partnership, Sacramento, Calif.

[21] Appl. No.: 330,349

[22] Filed: Dec. 14, 1981

[51] Int. Cl.[3] ..... B42D 15/00

[52] U.S. Cl. ..... 283/75; 40/626; 283/110; 283/111

[58] Field of Search ..... 283/7, 8 R, 9 R, 75, 283/91, 94, 110, 111; 356/71; 40/2.2, 626

[56] References Cited

U.S. PATENT DOCUMENTS

| | | | |
|---|---|---|---|
| 3,871,119 | 3/1975 | Mayer | 40/2.2 |
| 3,897,964 | 8/1975 | Oka et al. | 283/7 |
| 3,919,447 | 11/1975 | Kilmer, Jr. et al. | 283/8 R X |
| 3,930,924 | 1/1976 | Oka et al. | 283/7 X |
| 3,950,608 | 4/1976 | Noda et al. | 358/256 |
| 4,052,739 | 10/1977 | Wada et al. | 358/299 |
| 4,151,666 | 5/1979 | Raphael et al. | 283/7 X |

*Primary Examiner*—Fred Silverberg

*Attorney, Agent, or Firm*—Nilsson, Robbins, Dalgarn, Berliner, Carson & Wurst

[57] ABSTRACT

A latent image identification card has a translucent base with a multiplicity of engraved scores extending through a generally opaque top layer into the base layer whereby a "negative" image appears when the background light is below a determinable value and a latent, "positive" image appears when the background light passing through the translucent base is above the determinable value.

12 Claims, 6 Drawing Figures

IDENTIFICATION CARD BEARING LATENT IMAGE PERCEPTIBLE IN THE PRESENCE OF BACKGROUND LIGHT

BACKGROUND OF THE INVENTION

This invention relates to identification cards and in particular to machine engraved identification cards.

Engraved identification cards are known and can be made utilizing any one of a number of available electronic engraving systems such as that disclosed in Noda, et al., U.S. Pat. No. 3,950,608 or Wada et al., U.S. Pat. No. 4,052,739 or any other engraving system. Utilizing an electronic engraving system, an image can be engraved in an identification card blank by making a multiplicity of scores through one opaque colored plastic layer of the card blank into a second different colored opaque plastic layer of the card blank. By altering the depth of the scoring, the width of the region between scores can be continuously varied to generate light and dark regions which make up the desired image. A complete description of such prior art identification cards and the method of making them is disclosed in Oka, et al., U.S. Pat. No. 3,897,964 and Oka et al., U.S. Pat. No. 3,930,924.

As indicated, however, such identification cards required an opaque base of one color overlaid with an opaque layer of a contrasting color so that light impinging on the engraved surface of the card is variably reflected back to the eye of the observer according to the location and amount of the top layer removed to expose the bottom layer to form an observable image.

By contrast, the present invention provides a translucent base with but a single colored layer which is disposed across one surface of the translucent base. Engraving occurs through the colored layer into the translucent base to variably expose the translucent base. Background light then passes through the translucent base material in only those regions not covered by the opaque regions, i.e., where the opaque layer has not been removed by the engraving process.

The image is therefore a result of the contrast between the background light passing through the translucent base in those regions where the single colored layer has been removed and the light reflected from the front of the card in the regions where the colored layer has not been removed. This is in contrast to prior art cards which rely solely upon the variable reflectivity of light from the two opaque layers on the front of the engraved card. Thus, in prior art cards, background light is irrelevant.

A surprising and particular advantageous feature of the present invention is that both a "negative" and a "positive" image can be observed on the novel identification card in accordance with the invention even though only a single image is engraved. By way of explanation, because the image observed depends on the contrast between the background light passing through the translucent base and the foreground light reflecting off of the colored layer on the front of the card, when the amount of background light is below a certain level, the engraved image looks like a photographic negative whereas when the background light is above a particular level then the engraved image looks like a photographic positive.

This dual image effect provides an inherent security feature whereby the authenticity of a particular card can be tested without special equipment or user training. For example, if the engraved image is removed from the card by scraping the engraved surface of the identification card and then printing another image on the card, the above-described dual image effect will not be created. Hence, such a counterfeit card will be readily discernible simply by holding the identification card up to the light. By contrast, prior art identification cards can be altered by scraping the engraved region of the card, printing or substituting a new image on the card, and then making scores across the printed or substituted image to simulate an engraved surface.

SUMMARY OF THE INVENTION

A latent image identification card includes a translucent base having a surface with a plurality of depressions engraved therein for defining a plurality of non-engraved surface regions of varying dimension along the surface between the engraved depressions. An opaque or semi-opaque layer covering the non-engraved surface regions is provided so that a "negative" image appears when the background light passing through the translucent base is less than a determinable value and a latent, "positive" image appears when the background light passing through the translucent base is greater than the determinable value.

In one embodiment, the opaque layer may comprise a layer disposed on the translucent base surface prior to engraving so that the plurality of depressions are engraved through the opaque layer into the translucent base.

In an alternative embodiment, the card in accordance with the invention has an opaque layer which comprises an ink layer disposed only on the non-engraved surface regions after the engraving of the translucent base is completed.

In the above embodiments, the opaque layer may be a single white layer. However, the opaque layer may consist of a first layer having a first color which is disposed against the non-engraved surface regions of the translucent base and a second layer having a color contrasting with the first color, disposed to cover the first layer whereby the latent image appears only when the card is viewed from the back so that the first layer is viewed through the translucent base.

In still another embodiment, the non-engraved surface of the translucent base opposite the engraved surface may be provided with a semi-light transmissive layer disposed so as to increase the amount of background light required to enable observation of the latent image.

As used herein, translucent is intended to include transparent and reference to an opaque layer is intended to include a semi-opaque layer.

BRIEF DESCRIPTION OF THE DRAWINGS

A complete understanding of the present invention and of the above and other advantages and features thereof may be gained from a consideration of the following description of the preferred embodiments taken in conjunction with the accompanying drawings in which.

DETAILED DESCRIPTION

Figure 1:
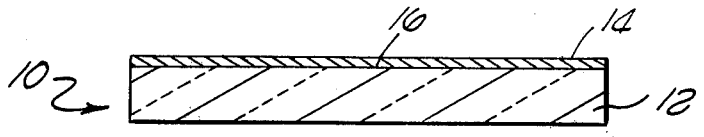
FIG. 1 is a two-layered card blank with a translucent base and an opaque layer.
Figure 2:
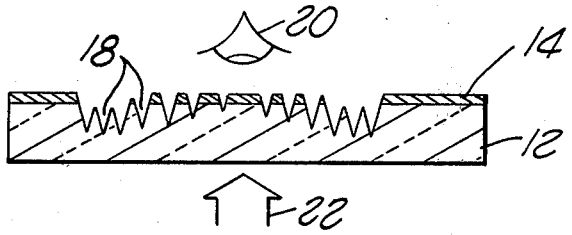
FIG. 2 is the card blank shown in FIG. 1 with a plurality of engraved scores thereacross.

Referring initially to FIGS. 1 and 2, an engraved identification card in accordance with one embodiment of the invention is illustrated as comprising a unitary card blank 10 having a translucent base layer 12 made from a suitable engravable material such as polyvinyl chloride (PVC) and an opaque layer 14 disposed to cover one surface 16 of the translucent base 12. The layer 14 may be made of plastic, ink or any other suitable opaque material which can be applied to and made to adhere to the translucent base 12 to form the unitary card blank.

The top layer 14 may be of any desired color but preferably it is white and it is substantially opaque. However, it will be appreciated that varying amounts of light may pass through the layer 14 in a more or less diffused manner depending upon the thickness, opacity and color of the layer 14 without departing from the invention.

Suitable indentations or scores are made in the card blank 10 utilizing a suitable electronic engraving apparatus to create an engraved image on the card blank 10.

Referring specifically to FIG. 2, a multiplicity of generally parallel scores 18 of varying depth may be scored so that the greater the depth of the scoring, the more of the opaque layer 14 which will be removed and hence the more background light 22 which will be allowed to pass through the translucent base 12 to the eye 20 of the observer. As the depth of a score decreases, the amount of the opaque layer in the region adjacent to the score increases thus decreasing the transmissivity of background light 22 through the translucent base 12.

Figure 3:
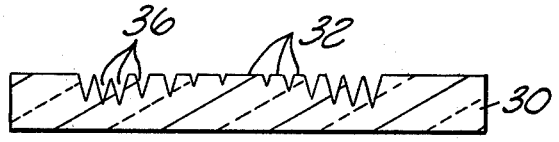
FIG. 3 is an engraved translucent base used to make the identification card illustrated in FIG. 4.
Figure 4:
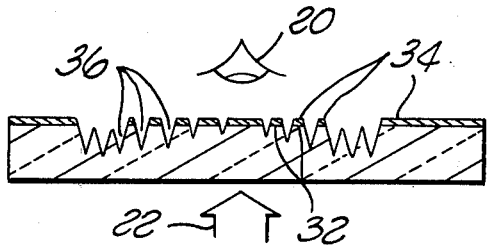
FIG. 4 is the engraved translucent base illustrated in FIG. 3 wherein an opaque ink layer is disposed on the non-engraved surface regions of the translucent base.

Referring to FIGS. 3 and 4, another embodiment of the invention is illustrated wherein a translucent base 30 is initially engraved utilizing an electronic engraving machine. The resultant engraved card includes for example, a multiplicity of scores 36 with non-engraved surface regions 32 of varying width therebetween. Of course, it will be appreciated that if the engraved scores are sufficiently deep then the entire surface region between adjacent scores will be removed and there will be no non-engraved surface regions 32. Therefore, the non-engraved surface regions or strips will have widths which vary inversely relative to the widths of the immediately adjacent parallel scores. In order to make the non-engraved surface regions substantially opaque to achieve the above-described latent image effect, a suitable vinyl ink may be applied over the engraved surface using a steel roller. The vinyl ink is thereafter dried by any suitable means such as by exposure to infra-red light, so that it becomes bonded to the surface of the base 30. The resultant identification card is illustrated in FIG. 4 and includes a translucent base 30, with a substantially opaque ink 34 bonded to the non-engraved surface regions 32, between the engraved scores 36.

Of course, it will be appreciated that the generally opaque ink may be applied to the non-engraved surface regions of the translucent base by any suitable means so long as the ink does not fill the scores 36. Thus, the viscosity of the ink must be selected so as to not flow once it is applied and the application method must be such as to limit the amount of ink so that it is applied just to the non-engraved surface regions 32.

In addition the ink must become bonded to the non-engraved surface regions during the drying or curing process to prevent easy removal. A suitable vinyl ink should be sufficiently hard when dry so as not to scratch during the engraving process. One such ink may be the vinyl base laminating black ink produced by Sinclair and Valentine of Kansas City, Kansas.

Figure 5:
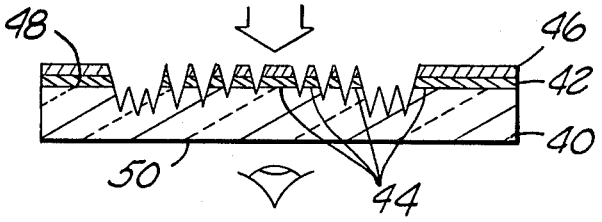
FIG. 5 is another embodiment of the invention having a configuration similar to the embodiments of FIGS. 2 and 4 but additionally including a generally dark-colored opaque layer disposed on the exposed surface regions of the first opaque layer on the translucent base.

Referring to FIG. 5, yet another embodiment of the invention is illustrated comprising a translucent, preferably colorless base layer 40 and an opaque, preferably white layer 42 disposed on the non-engraved surface regions 44 of the base 40 in any suitable manner such as that described in conjunction with FIGS. 1 through 4. In order to increase the opacity of the layer 42 and thereby increase the contrast of the engraved image, a second opaque layer 46 is disposed to cover the opaque layer 42. In the preferred embodiment the opaque layer 42 is white while the opaque layer 46 is a dark color such as black. In such an arrangement, the image as viewed from the engraved side of 48 will be a normal positive image regardless of the background light. However, when the image is viewed from the non-engraved side 50 through the transparent base, the dark layer 46 will be hidden by the opaque white layer 42 and a negative image will appear when the level of background light is above a determinable level.

Because the negative/latent image duality will be readily observable only by viewing the card from the non-engraved side 50 in the embodiment of FIG. 5, it will be appreciated that any engraved alphanumeric characters or images will have to be engraved as the inverse or mirror image of the image desired to be seen. Suitable inversion routines can be incorporated in the above-identified electronic engraving systems or alternatively, the image to be engraved can simply be reflected in a conventional mirror and the reflected image then stored and subsequently engraved in a manner described in the above-identified patents for electronic engraving systems.

Figure 6:
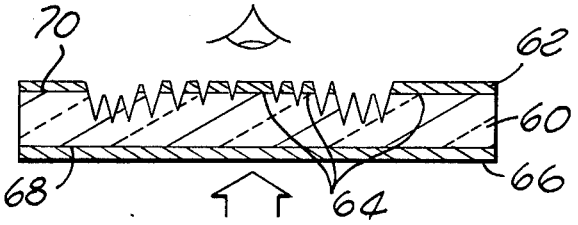
FIG. 6 is another embodiment of the invention incorporating a semi-light transmissive layer over the surface of the base opposite the engraved surface.

Referring to FIG. 6, a modification of the embodiments illustrated in FIGS. 1 through 4 is shown where a translucent base 60 with a substantially opaque layer 62 covering a non-engraved surface region 64, has a semi-light transmissive layer 66 disposed to cover the surface 68 of the translucent base 60 opposite the engraved side 70. The effect of the semi-light transmissive layer is to increase the amount of background light which must impinge on the card and pass through the light transmissive layer and the translucent base 60 to enable the latent, positive image to be viewed from the engraved side 70 of the card. As previously indicated, the opacity of the layer 66 may be altered by varying the pigment concentration in the material used to form the layer 66, by altering the thickness of the layer 66, or by altering the color of the layer 66. The layer 66 may in one example be a thin layer of the above-identified vinyl ink used to form the opaque layer 36 in FIG. 4.

The means of bonding the opaque layers above-described in conjunction with FIGS. 1 through 6 to the card blank includes adhesive attachment using a suitable colorless transparent adhesive such as a PVC adhesive well-known in the art, heat bonding or fusing, or any other suitable technique well-known in the art. Alternatively, the layers may be made of opaque ink suitably applied to the translucent base either before or after the engraving process. The ink layers may be fused into the top surface region of the translucent base material by heating processes well-known in the art or may simply be bonded as a consequence of the drying or curing process. Such techniques are well-known in the art.

Various other embodiments and variations with regard to the above invention are possible to produce an identification card in which a latent positive image will appear in response to a sufficient degree of background light passing through the translucent regions of the colorless base without departing from the spirit and scope of the present invention.

What is claimed is:

1. A latent image identification card for being viewed in the presence of background light comprising:

a translucent base having a surface with a plurality of depressions engraved therein for defining a plurality of non-engraved regions of varying dimensions between the engraved depressions: and a substantially opaque layer covering only the non-engraved regions;

such that a negative image appears when the background light passing through the translucent base is less than a determinable value, and a latent, positive, image appears when the background light passing through the translucent base is greater than the determinable value.

2. The latent image identification card of claim 1 wherein the translucent base is colorless.

3. The latent image identification card of claim 1 wherein the opaque layer comprises a layer on the translucent base engraved surface, the plurality of depressions being engraved through the opaque layer into the translucent base.

4. The latent image identification card of claim 1 wherein the opaque layer comprises an ink layer disposed on the non-engraved regions after the translucent base engraved surface is engraved.

5. The latent image identification card of claims 1, 3, or 4 wherein the opaque layer is white.

6. The latent image identification card of claim 5 wherein the translucent base has a non-engraved surface opposite the engraved surface, the card further comprising a semi-light transmissive layer disposed on the non-engraved surface.

7. The latent image identification card of claims 1, 3, or 4 wherein the opaque layer comprises:

a first colored layer having a first color disposed on the non-engraved regions of the translucent base, and a second colored layer having a second color which contrasts with the first color disposed to cover the first colored layer whereby the latent image appears when the card is positioned so that the first colored layer is viewed through the translucent base.

8. The latent image identification card of claim 7 wherein the first color is white and the second color is black.

9. The latent image identification card of claim 7 wherein the image engraved on the translucent base engraved surface is the mirror image of the image to be viewed through the translucent base.

10. The latent image identification card of claim 7 wherein the translucent base has a non-engraved surface opposite the engraved surface, the card further comprising a semi-light transmissive layer disposed on the non-engraved surface.

11. The latent image identification card of claims 1, 3, or 4 wherein the translucent base has a non-engraved surface opposite the engraved surface, the card further comprising a semi-light transmissive layer disposed on the non-engraved surface.

12. The latent image identification card of claims 1, 3, or 4 wherein the plurality of engraved depressions comprise a plurality of engraved regions of varying widths whereby the non-engraved regions are surface strips having widths which vary inversely relative to the widths of the immediately adjacent parallel engraved regions.

* * * * *